United States Patent [19]

Lecinski et al.

[11] Patent Number: 4,570,811

[45] Date of Patent: Feb. 18, 1986

[54] PLASTIC CLOSURE WITH FLOWED-IN PLASTISOL LINING

[75] Inventors: Frank H. Lecinski, Harwood Heights; John N. Banich, Sr., Chicago, both of Ill.

[73] Assignee: Continental White Cap, Inc., Northbrook, Ill.

[21] Appl. No.: 696,470

[22] Filed: Jan. 30, 1985

[51] Int. Cl.[4] ..... B65D 53/00

[52] U.S. Cl. ..... 215/343; 215/352

[58] Field of Search ..... 215/341, 343, 345, 344, 215/352, 350; 264/274

[56] References Cited

U.S. PATENT DOCUMENTS 4,331,249 5/1982 Banich ..... 215/343

FOREIGN PATENT DOCUMENTS 464721 12/1968 Switzerland ..... 215/341

*Primary Examiner*—Donald F. Norton

*Attorney, Agent, or Firm*—Charles E. Brown

[57] ABSTRACT

This relates to the securement of a flowed-in plastisol liner in a plastic closure member. The closure member is provided with a channel-shaped seat into which plastisol material is flowed, and after which the plastisol material is cured. Air which is normally entrapped between the plastisol liner and walls of the seat is greatly reduced by providing a seat with a plurality of abutments or projections which extend into the seat and the base thereof and wherein the abutments are generally of a tapered configuration and terminate in the base in fillets or radii which permit the flow of air from around the abutments as the plastisol liner material is flowed into the seat. Also, top portions of the abutments are provided with interlocking elements in the form of slots, crosses and the like into which the liner material flows and forms a mechanical interlock between the plastisol liner and the abutments, thereby preventing relative rotation between the plastisol liner and the closure member.

15 Claims, 9 Drawing Figures

PLASTIC CLOSURE WITH FLOWED-IN PLASTISOL LINING

This abstract is not to be construed as limiting the claims of the application.

This invention relates in general to new and useful improvements in the retention of flowed-in plastisol liner material inside of a plastic closure. More particularly this invention constitutes an improvement over the closure assembly disclosed in U.S. Pat. No. 4,331,249, granted to John N. Banich, Sr. on May 25, 1982.

Many methods of retaining flowed-in plastic liner materials inside of a plastic closure member have been used. Concentric rings, channels, domes, dimples, cross-hatching and undercuts all have been used with some degree of success in retaining cured flowed-in plastisol liner materials within a closure member with one drawback. All prior securing modes tend to trap air in the lower corners where the securing devices meet the closure member top panel.

When curing the plastisol liner material, the trapped air tends to blister, thus weakening the interface of the plastisol liner to the plastic closure member and the provided retaining devices. The weakened interface can cause separation of the plastisol liner material from the plastic closure member upon removal of the closure unit from a container, and thereby reduce the effective resealing of the closure to the container.

In accordance with this invention, by the addition of radii or fillets at the juncture of the domes or dimples and the closure end panel, air entrapment is minimized and allows for more plastisol liner/closure interface, thereby minimizing the separation of the plastisol liner from the closure on opening. This, in turn, maintains closure/liner integrity on reuse of the closure/liner and container.

It is also proposed to provide an interlock between the tops of the domes and the liner so as to prevent closure/plastisol liner rotation when the closure is applied or removed from a container.

It is to be understood that the shape of the projections or abutments may be other than than of a dome or dimple, including cones and frustoconical shapes. In addition, in lieu of simple slots for providing the interlock, the tops of the abutments may be provided with crosses, stars, and the like.

With the above and other objects in view that will hereinafter appear, the nature of the invention will be more clearly understood by reference to the following detailed description, the appended claims, and the several views illustrated in the accompanying drawings.

Figure 1:
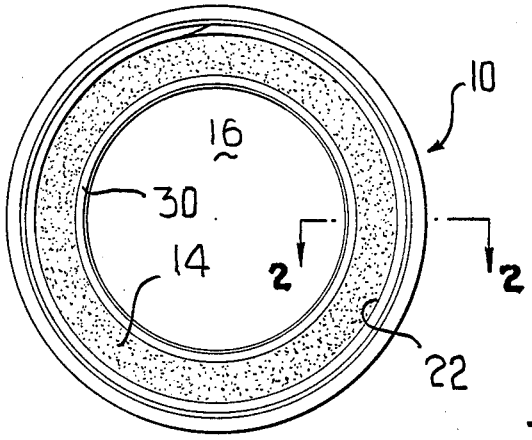
FIG. 1 is a bottom plan view of a conventional plastic closure member having a plastisol liner retained therein in accordance with this invention.

Referring now to the drawings in detail, it will be seen that there is illustrated a closure unit generally identified by the numeral 10, the closure unit including a plastic closure member 12 and a plastisol liner 14. With the exception of the manner in which the plastisol liner is secured in place with respect to the closure unit 12, it is to be understood that the closure unit 12 is of a conventional construction.

The illustrated closure member 12 includes an end panel 16 joined at a corner 18 to a depending skirt 20. The skirt 20 is provided internally with suitable threadings 22.

The end panel 16 is provided on its inner surface with a channel cross-sectional seat 24 in which the plastisol liner 14 is seated. Actually the plastisol liner material is flowed into the seat 24 and is shaped thereby.

The channel shaped seat 24 has a base 26 which is defined by the inner surface of the end panel 16. The seat 24 also has an outer side wall 28 defined by a radially inner surface of the skirt 20 adjacent the corner 18. There is also an annular rib 30 depending from the undersurface of the end panel 16. The rib 30 has a radially outer surface 32 defining the opposite side wall of the seat 24.

Figure 2:
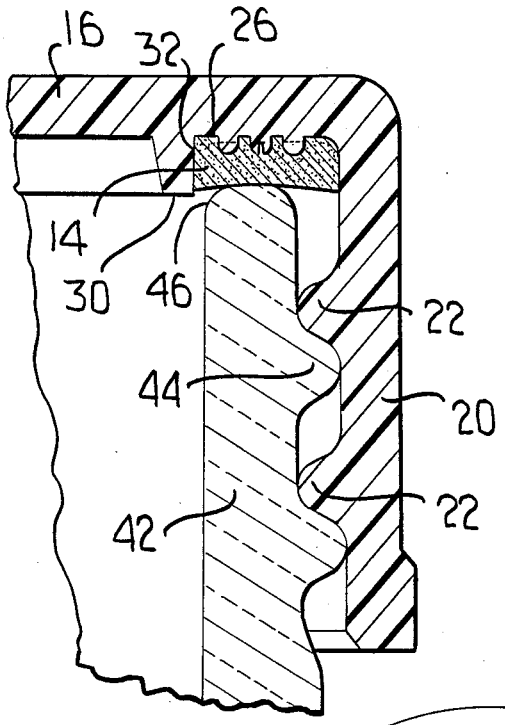
FIG. 2 is an enlarged fragmentary sectional view taken generally along the line 2—2 of FIG. 1 through the closure unit, and showing the same lightly applied to a container.

In accordance with customary practice, plastisol liner material is flowed into the seat 24, filling the same as shown in FIG. 2.

The closure unit 10 as described is conventional. This invention relates to the manner in which the plastisol liner 14 is retained in the seat 24.

As is clearly shown in the various views of FIGS. 1–5, the base 26 has depending therefrom a plurality of abutments 34. In the illustrated embodiment of the invention, the abutments 34 are arranged in concentric circles with the abutments of each circle being uniformly spaced and adjacent abutments lying along radial lines. However, it is to be understood that the abutments need not be arranged in such a pattern, but could be arranged in any desired pattern, either regular or irregular.

Figure 5:
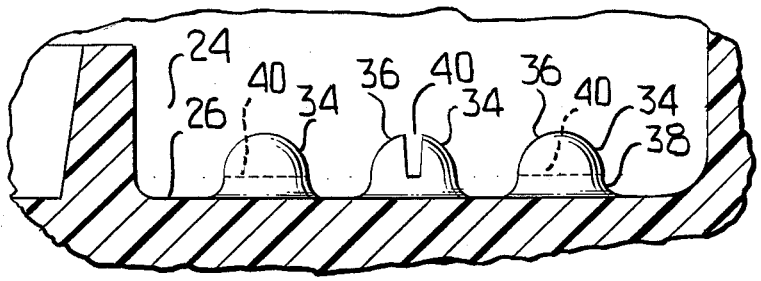
FIG. 5 is an inverted fragmentary sectional view taken generally along the line 5—5 of FIG. 4, and shows the specifics of abutments depending from the closure member end panel for interlocking within the plastisol liner.

A principal feature of the abutments, with respect to the abutments 34 specifically illustrated in FIG. 5, is that each abutment 34 is in the form of a dome or dimple having a generally rounded or hemispherical top portion 36. However, in lieu of there being a generally cylindrical or cross-sectional base portion directly joined to the base 26, each dome or dimple 34 has a radius or fillet 38 so that the contour of the dimple or dome 34 flows smoothly into the flat surface of the base 26.

As described above, this feature permits air which would normally be entrapped within the plastisol liner material to flow from around the abutments 34 and out of the seat 24 as the plastisol liner material is flowed into the seat 24.

Figure 4:
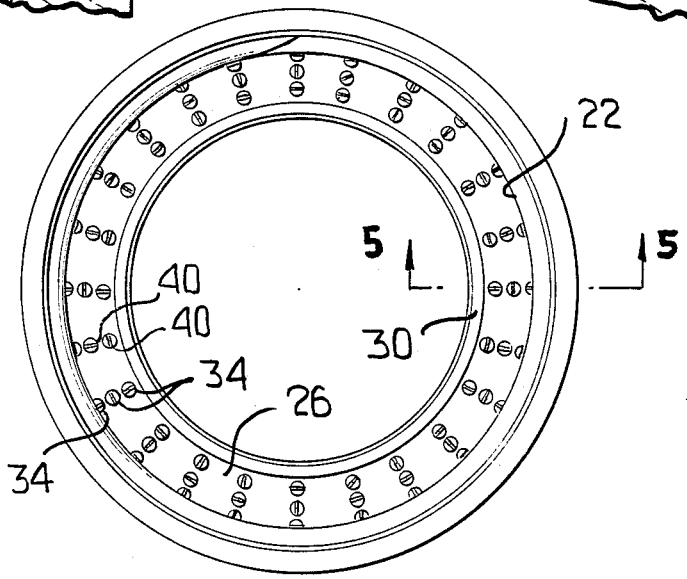
FIG. 4 is a bottom plan view of the closure member per se prior to the application of the plastisol liner.

Another feature of the invention is clearly shown in FIGS. 4 and 5 wherein each of the dimples or domes 34 is provided with a slot 40. As is clearly shown in FIG. 4, the slots 40 of the adjacent domes 34 are disposed in angular relation to one another with the illustrated angle being 90°, although the angle may be varied.

By providing the domes or dimples 34 with the transverse slots 40, the flowed-in plastisol liner material will be interlocked with the domes or dimples 34 so as to prevent relative rotation between the closure member 12 and the plastisol liner 14 upon application or removal of the closure unit 10 from a container.

At this time it is pointed out that in lieu of the simple slots 40 illustrated in FIGS. 4 and 5, they may be in the form of crosses in plan. They may also be of a star-like outline. The main purpose is to provide a space in the simple or dome 34 into which the plastisol liner material may flow so as to form an interlock.

Figure 3:
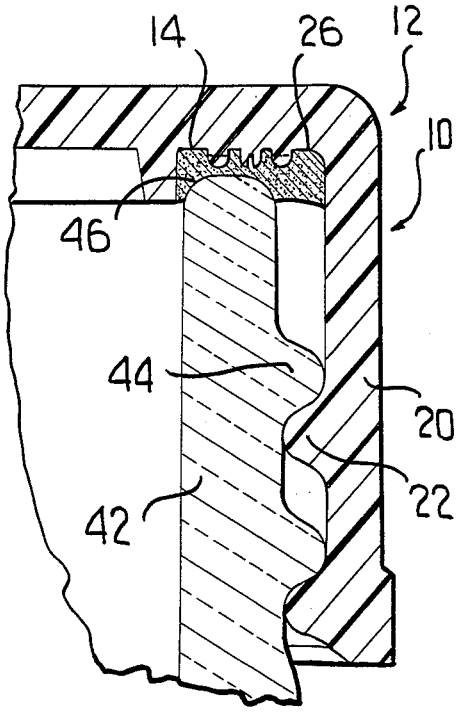
FIG. 3 is an enlarged fragmentary sectional view similar to FIG. 1, and shows the closure unit fully applied.

In FIG. 2 the closure unit 10 is illustrated as being applied finger-tight to a container 42 having an exterior threaded finish 44. As the closure unit 10 is rotated, a sealing finish 46 of the container neck finish will be forced under pressure into the plastisol liner 14 to enhance the seal therewith. This is shown in FIG. 3. It will be apparent that there will be a tendency for the plastisol liner 14 to remain stationary with the container 42 as the closure unit 10 is rotated and is applied.

It has been found through the formation of closure units such as the closure unit 10 that there are less voids between the plastisol liner 14 and the surfaces of the seat 24, particularly the base 26, than has heretofore been possible. It has also been found that the tendency of the plastisol liner to remain stationary with the container 42 and thus rotate relative to the closure member 12 has been greatly reduced.

Figure 6:
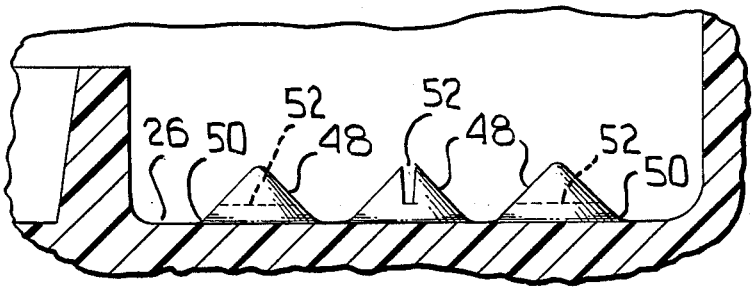
FIG. 6 is a fragmentary sectional view similar to FIG. 5, and shows a modified abutment shape.
Figure 7:
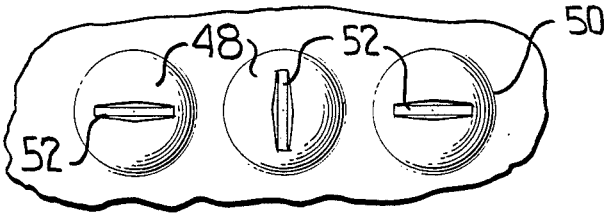
FIG. 7 is a fragmentary bottom plan view showing the arrangement of interlocking slots in the abutments of FIG. 6.

It is to be understood that the dimples may have a configuration other than that of the dome 34. Accordingly, reference is made to FIGS. 6 and 7 wherein the dimples are in the form of cones 48. As in the case of the domes 34, there is no direct termination of the cones 48 at an intersection with the base 26. Instead, there is provided a radius or fillet 50 between the base portion of the cone 48 and the base 26. The radius or fillet 50 functions in the manner described above with respect to the radius or fillet 38.

The cones 48 will also be provided with transverse slots 52 or the like for providing a mechanical interlock between the flowed-in plastisol liner material and the cones 48 to provide interlocks similar to those previously described with respect to the dimples 34.

Figure 8:
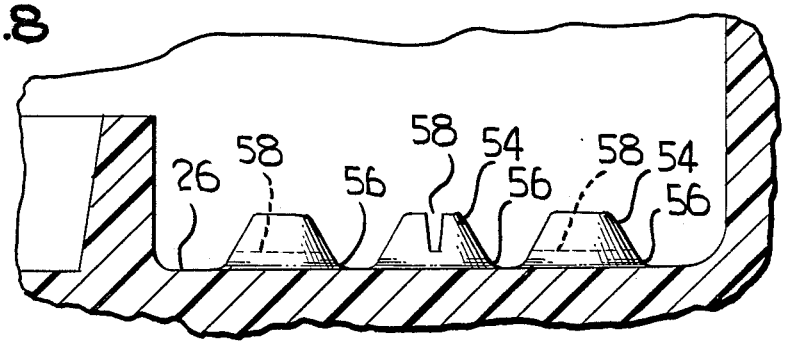
FIG. 8 is another fragmentary vertical sectional view similar to FIG. 5, and shows still another form of abutment shape.
Figure 9:
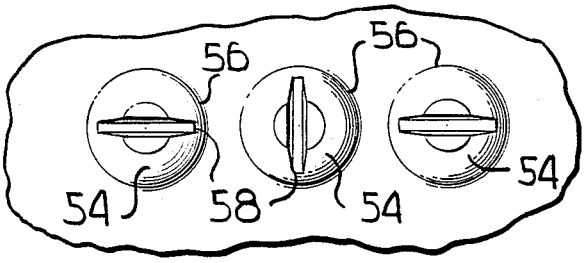
FIG. 9 is a fragmentary bottom plan view showing the general configuration of the abutments of FIG. 8.

It is also to be understood that the dimples may be of shapes other than domes and cones. An example of such additional shape is shown in FIGS. 8 and 9 where the dimples are of a frustoconical configuration and are identified by the numeral 54. The frustoconical dimples 54 also do not have a direct termination at the base 26, but include base portions in the form of radii or fillets 56.

The frustoconical dimples 54 will also be provided with means for facilitating the interlocking of the plastisol liner material with the dimples. Such interlocking means may be in the form of simple slots 58 similar to the slots 40, 52 or may be of more complex configuration as previously described.

Although only several preferred embodiments of the dimple configurations have been specifically illustrated and described herein, it is to be understood that minor variations may be made in the dimple configuration and the relationship thereof to the closure member and the plastisol liner without departing from the spirit and scope of the invention as defined by the appended claims.

We claim:

1. A closure having a seat for a liner, said seat being generally channel-shaped in cross section and including a base, said seat being improved by a plurality of abutments projecting from said base into said seat for interlocking with a liner when placed in said seat, said abutments each having at its connection with said base a fillet for preventing entrapment of air as a liner is being applied into said seat.

2. A closure according to claim 1 wherein said closure is an injection molded plastic closure.

3. A closure according to claim 1 wherein a liner is seated in said seat, said liner being formed of a curable plastisol material.

4. A closure according to claim 1 wherein said fillet in cross section is a radius.

5. A closure according to claim 1 wherein said each abutment is in the form of a dome.

6. A closure according to claim 1 wherein said each abutment is in the form of a cone.

7. A closure according to claim 1 wherein said each abutment is in the form of a cone having a flat top.

8. A closure according to claim 1 wherein said each abutment is in the form of a frustoconical member.

9. A closure according to claim 1 wherein said each abutment is in the form of a frustoconical member having a flat top.

10. A closure according to claim 1 wherein each of said abutments has a top, and said top has a recess therein for receiving liner material in interlocking relation.

11. A closure according to claim 10 wherein each recess is in the form of a transverse slot.

12. A closure according to claim 10 wherein each recess is in the form of a transverse slot, and said slots in adjacent abutments extend in different directions.

13. A closure according to claim 10 wherein each recess is in the form of a transverse slot, and said slots in adjacent abutments extend in different directions generally at right angles to one another.

14. A closure according to claim 10 wherein each recess is in the form of a cone.

15. A closure according to claim 10 wherein each recess is in the form of a star.

* * * * *